US007082937B1

(12) United States Patent
Land

(10) Patent No.: US 7,082,937 B1
(45) Date of Patent: Aug. 1, 2006

(54) ARCHERY BOW AND CAM ARRANGEMENT

(76) Inventor: Spencer Land, 404 Lost Trail Dr., Henderson, NV (US) 89014

( * ) Notice: Subject to any disclaimer, the term of this patent is extended or adjusted under 35 U.S.C. 154(b) by 0 days.

(21) Appl. No.: 10/828,752

(22) Filed: Apr. 21, 2004

(51) Int. Cl.
*F41B 5/10* (2006.01)

(52) U.S. Cl. ..... 124/25.6; 124/900

(58) Field of Classification Search ..... 124/25.6, 124/900
See application file for complete search history.

(56) References Cited

U.S. PATENT DOCUMENTS 5,934,265 A * 8/1999 Darlington ..... 124/25.6
6,082,346 A 7/2000 Andrews et al.
6,250,293 B1 6/2001 Andrews
6,360,735 B1 * 3/2002 Larson et al. ..... 124/25.6
6,446,619 B1 * 9/2002 McPherson ..... 124/25.6
6,575,153 B1 * 6/2003 Lommasson et al. ..... 124/25.6
6,691,692 B1 * 2/2004 Adkins ..... 124/25.6
6,871,643 B1 * 3/2005 Cooper et al. ..... 124/25.6

* cited by examiner

*Primary Examiner*—John A. Ricci
(74) *Attorney, Agent, or Firm*—Reising, Ethington, Barnes, Kisselle, P.C.

(57) ABSTRACT

A cam for an archery bow is constructed comprising a body for guided entrainment of a bow string. The body accommodates an axle for mounting the body to the bow for rotation about an axis of the axle. At least one adjuster is carried by the body for adjustment between at least two positions. The adjuster is arranged in a first position to define a first draw weight and draw length of the bow, and in a second position to define a second draw weight of the bow. At least one of the draw weights and draw lengths are different, so that moving the adjuster from its first position to its second position changes either the draw weight, draw length, or both.

41 Claims, 8 Drawing Sheets

ARCHERY BOW AND CAM ARRANGEMENT

FIELD OF THE INVENTION

This invention relates generally to archery bows, and particularly to cams for archery bows.

BACKGROUND OF THE INVENTION

Archery bows typically have a pair of pulleys, with at least one of the pulleys having a cam surface to provide a mechanical advantage in drawing a drawstring of the bow. Archery bows having a pulley arrangement are commonly referred to "compound bows". Typically, a user purchases a compound bow having the desired draw length that suits their physical size. To adjust the draw length of a compound bow, typically the user must seek assistance from an experienced technician to install the proper length draw string and/or pulley having the desired characteristics to provide the desired draw length. This often limits the offering of bows a purchaser has to choose from, and also proves inconvenient in having to seek out assistance from an experienced technician to install the proper length draw string and/or change the pulley or cam.

In addition, the user must also select a bow having a suitable range of draw weight to accommodate the user's strength and ability to draw back the drawstring. Typically, compound bows have a pair of bow limbs attached to a riser with a pair of limb bolts. To adjust the draw weight of the bow, it is known to provide a limited amount of adjustment by loosening the bolts to decrease the draw weight, or tightening the bolts to increase the draw weight. Typically, adjustment of the limb bolts allows for a draw weight adjustment over range of 10. Though the draw weight may be adjusted by tightening and loosening the limb bolts, compound bows typically operate most efficiently when set near the upper limit. Loosening the limb bolt also reduces the number of threads securing the limb bolt to the riser. As such, users are typically best suited if they purchase a compound bow having an upper limit close to their desired draw weight. As such, though the user may have the ability to adjust the draw weight by almost 10 pounds, practically speaking, the user typically maintains the bow towards the upper end of the draw weight limit to achieve maximum efficiency and performance of the bow. Otherwise, to obtain a draw weight outside the range of adjustment of the limb bolts, other changes to the bow must be made, such as switching the limbs having different stiffness, and/or changing the cam pulley or pulleys. These changes require the assistance of an experienced technician and a bow press.

Further, compound archery bows typically have one pulley or cam providing for guided entrainment of a bow string at least in part over three laterally spaced planes.

SUMMARY OF THE INVENTION

A cam for an archery bow is constructed comprising a body for guided entrainment of a bow string. The body accommodates an axle for mounting the body to the bow for rotation about an axis of the axle. At least one adjuster is carried by the body for adjustment between at least two positions. The adjuster is arranged in a first position to define a first draw weight and draw length of the bow, and in a second position to define a second draw weight of the bow. At least one of the draw weights and draw lengths are different, so that moving the adjuster from its first position to its second position changes either the draw weight, draw length, or both. A plurality of positions for the adjuster may be provided so that the draw length and draw weights can be varied as desired. Preferably, there are at least some positions wherein the draw length may be adjusted without changing the draw weight, and vice versa.

Another aspect of the invention provides a cam for an archery bow for guided entrainment of a bow string having a draw string and a harness string. The cam has a body having a pair of tracks with a first track lying in a first plane and a second track lying in a second plane laterally spaced from the first plane. During at least a portion of a draw of the bow, the first track receives at least a portion of a draw string and the second track receives at least a portion of the draw string and at least a portion of a harness string.

Objects, features and advantages of this invention include providing a cam for an archery bow that has an adjustable maximum draw weight while maintaining a substantially constant draw length, an adjustable draw length while maintaining a substantially constant maximum draw weight, a positive stop to ensure a repeatable draw length, a readily adjustable maximum draw weight and/or draw length, a positive stop that is readily adjustable to adjust the magnitude of let-off from the maximum draw weight, is of relatively simple design and economical manufacture, permits a wide range of draw weight adjustment, permits a wide range of draw length adjustment, permits draw length and/or draw weight adjustment without having to disassemble the bow or change bow components, and is readily adaptable for use with a variety of compound bows.

BRIEF DESCRIPTION OF THE DRAWINGS

These and other objects, features and advantages of this invention will become apparent from the following detailed description of the preferred embodiments and best mode, appended claims and accompanying drawings in which:

DETAILED DESCRIPTION OF THE PREFERRED EMBODIMENTS

Figure 1:
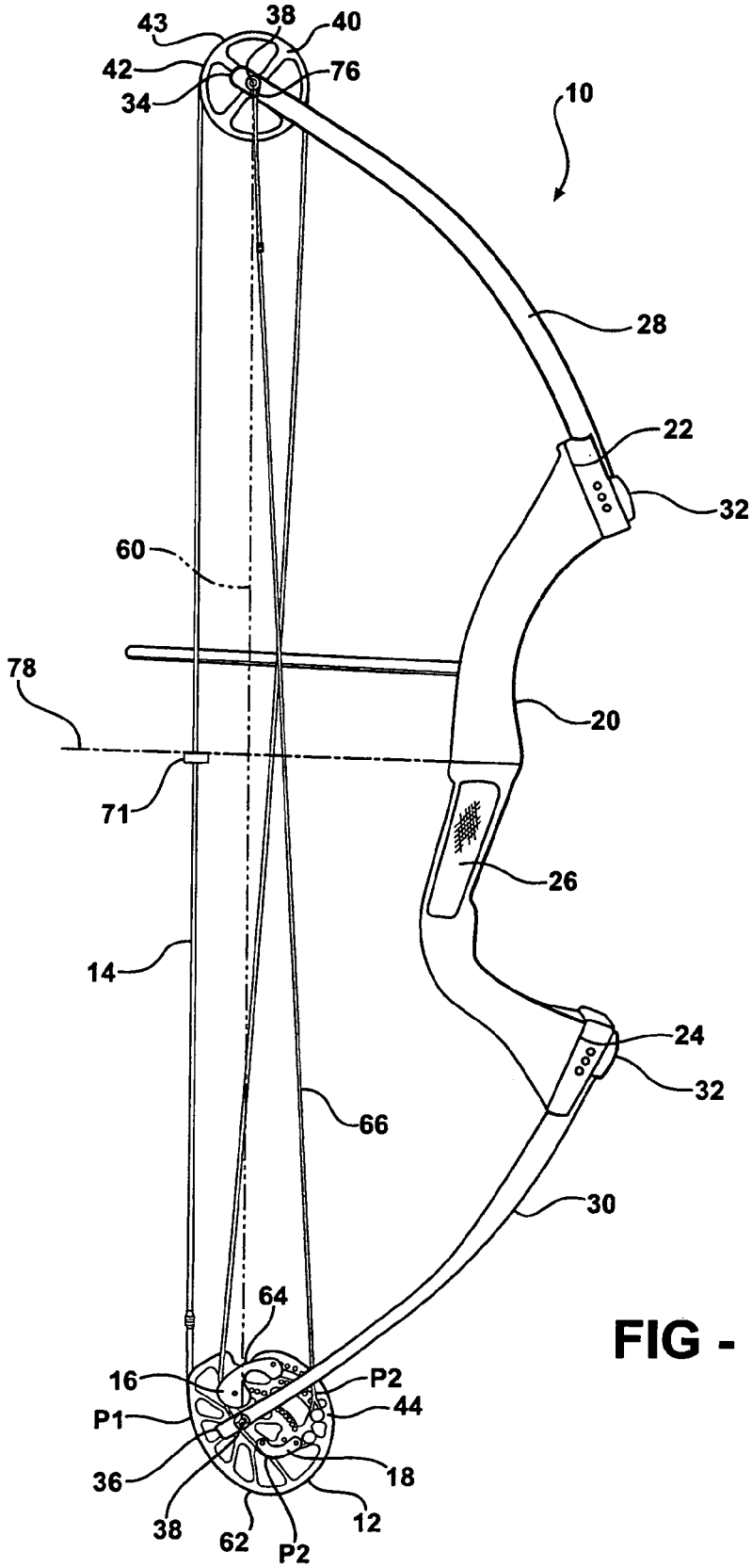
FIG. 1 is a side view of an archery bow having a cam constructed according to one presently preferred embodiment of the invention.

Referring in more detail to the drawings, FIG. 1 shows an archery bow 10 having at least one cam 12 with an adjustable member, referred to hereafter as an adjuster 16 that permits the draw weight of a draw string 14 to be changed. The adjuster 16 is, preferably adjustable over a plurality of settings, to permit adjustment of the maximum draw weight of the draw string 14 and preferably also permits adjustment of the draw length of the bow. Preferably, the cam 12 also has an adjustable let-off or stop 18 to adjust the amount of let-off or reduction in draw weight from the maximum draw weight in a fully drawn position of the draw string 14. The cam 12 is adjustable in a relatively quick and easy manner, and in some cases, does away with the need for a bow press (not shown) while making adjustments to the bow 10.

As shown in FIG. 1, and as commonly known in compound archery bows, the bow 10 has a riser 20 with generally opposite ends 22, 24 and a handle 26 located generally between the ends 22, 24. Typically, a pair of limbs 28, 30 are attached to the riser 20 by a pair of limb bolts 32 adjacent the ends 22, 24 of the riser 20. The limb bolts 32 preferably can be rotated either clockwise or counterclockwise to adjust the maximum draw weight of the draw string 14 over a relatively limited range of draw weights. The maximum draw weight for a given setting of the bow is the greatest weight or force that must be applied to the draw string 14 during a full draw of the draw string 14. When the draw weight of the drawstring or bow is referred to herein, the maximum draw weight for a given bow setting will be implied unless it is indicated otherwise. Typically, the limb bolts 32 provide a range of draw weight adjustment of about 10 pounds.

Each limb 28, 30 has a free end 34, 36 spaced from the riser 20 with an axle passage arranged to carry an axle 38. One axle 38 rotatably carries the cam 12, and the other axle 38 typically rotatably carries an idler wheel 40. It should be recognized that though the bow 10 is shown here having the cam 12 in combination with the idler wheel 40, the bow 10 could be arranged having a pair of cams, without the use of the idler wheel.

The idler wheel 40 is typically a circular pulley having an outer perimeter 42 with a peripheral groove or track 43 in which the draw string 14 is entrained at least in part. The idler wheel 40 has an axle passage aligned with the axle passage in the limb 28 to receive the axle 38 for rotatably carrying the idler wheel 40.

The cam 12 has a body 44 with the adjuster 16 providing a user the ability to change either the maximum draw weight, the draw length of the draw string 14, or both, to adjust the bow as desired. In addition, the cam 12 preferably has the stop 18 adjustably attached to the body 44 to permit adjustment of the amount of reduction or let-off from the maximum draw weight of the draw string 14 in a fully drawn position of the draw string 14. Preferably, the body 44 has a generally non-circular outer perimeter 62 having a groove or track 63 (FIG. 8) therein forming one path for a portion of the draw string, and the adjuster 16 has an outer perimeter 64 at least in part with a track 65 (FIG. 8) therein to form at least part of another path for a portion of the draw string 14.

As best shown in FIGS. 2–7, to facilitate adjustment of the adjuster 16, the body 44 preferably has a plurality of holes, preferably arranged in at least two, and shown here as three adjustment arrays 46, 48, 50. Each adjustment array 46, 48, 50 provides at least in part for the adjustable attachment of the adjuster 16 to the body 44 via corresponding holes 46(*a*–*f*), 48(*a*–*f*) and 50(*a*–*f*), respectively.

To further facilitate attachment of the adjuster 16 to the body 44, preferably the body 44 has an attachment array 52 with another plurality of holes 52(*a*–*f*) preferably corresponding in number to the holes in each adjustment array 46, 48, 50. It should be recognized that other constructions may be used to attach the adjuster 16 to the body 44. For example, the holes may be replaced with slots, pins extending outwardly from the body, grooves in the body, and the like. It should also be recognized that any number of holes may be used to form the adjustment and attachment arrays, and that any number of adjustment and attachment arrays may be used.

Figure 6:
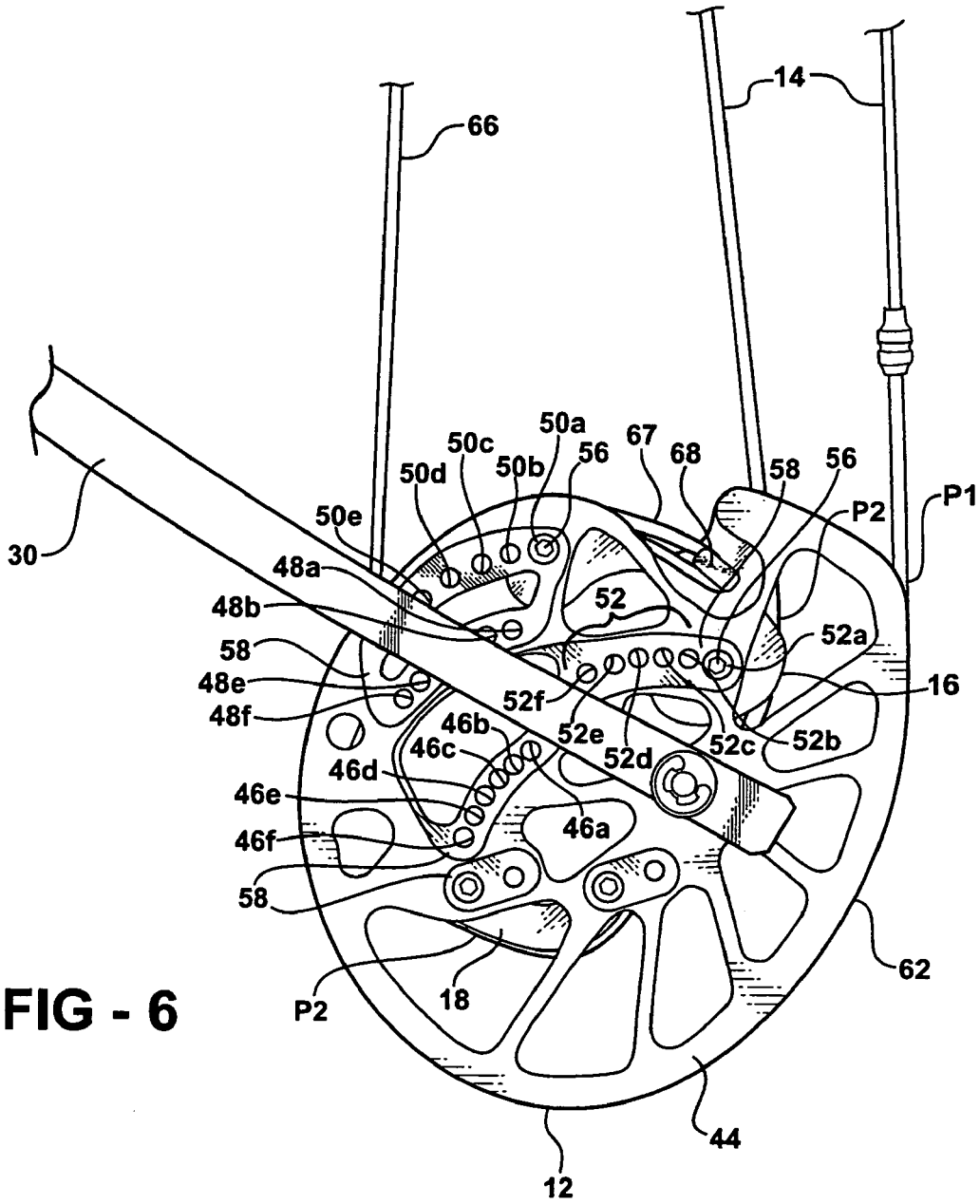
FIG. 6 is a side view of another side of the cam of FIG. 1 shown in an undrawn position.
Figure 7:
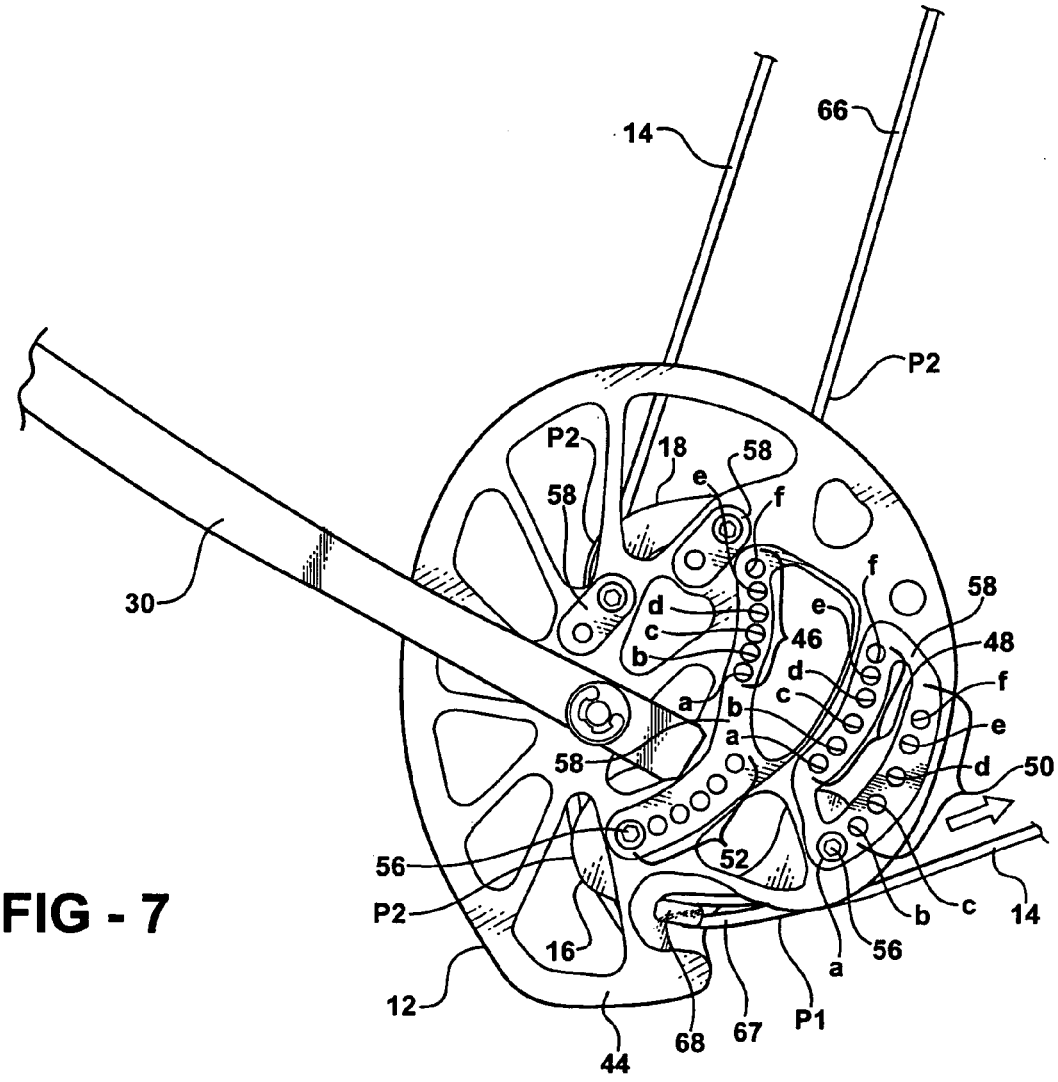
FIG. 7 is a view similar to FIG. 6 with the cam shown in a drawn position.

The adjuster 16 preferably has generally opposed first and second ends 51, 53 each having a threaded hole 54, 55 (FIGS. 2, 3 and 5) for receiving a threaded fastener 56 (FIGS. 6–7) that removably attaches the adjuster 16 to the body 44. The second end 53 of the adjuster 16 is attached to the cam body 44 via a chosen hole 46(*a*–*f*), 48(*a*–*f*), 50(*a*–*f*) of one of the adjustment arrays 46, 48, 50. The first end 51 of the adjuster 16 is attached to the cam body 44 via a corresponding hole 52(*a*–*f*) in the attachment array 52. As shown in FIGS. 6 and 7, to provide clearance between the fasteners 56 and the limb 30, preferably the fasteners 56 are recessed within pockets 58 formed in the side of the body 44. It should be recognized that other methods may be used to releasably secure the adjuster 16 to the body 44, for example, spring clips, clamps, and the like. It should also be recognized that the adjuster 16 may be constructed of a plurality of members, or pins, and that it is not limited to a single piece of material, as shown.

Figure 8:
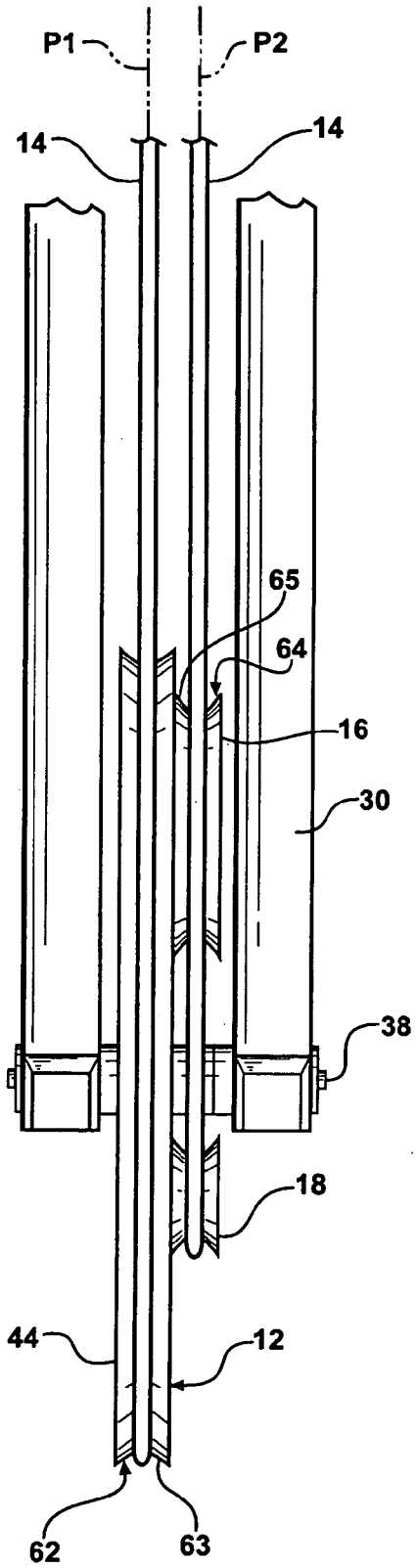
FIG. 8 is a partial front view of the bow with the cam shown in an undrawn position.

To facilitate attachment of the draw string 14 to the body 44, an end 67 of the draw string 14 is preferably looped for attachment around a post 68 which may be located adjacent the perimeter 62 of the body 44 (FIGS. 6–7). As best shown in FIG. 8, a portion of the draw string 14 lies in a plane generally designated (P1) as it coils and uncoils about the cam 12. The plane P1 includes the track 63 in the cam body 44. The draw string 14 is entrained at least in part around the track in the perimeter 62 of the body 44 and is preferably routed toward and entrained at least in part around the track in the perimeter 42 of the idler wheel 40. The draw string 14 is then routed back toward the cam 12, and the other end 69 of the draw string 14 is looped for attachment about another post 70 which may be located adjacent the stop 18. As such, another portion of the draw string 14 lies in another plane generally designated (P2) as it coils and uncoils about the cam 12. The plane P2 includes the track 65 in the adjuster 16 and is laterally spaced from, and preferably generally parallel and immediately adjacent to the plane P1. To facilitate positioning an arrow (not shown) on the draw string 14, preferably a nock point 71 is fastened in a desired position along the draw string 14.

A power or harness string 66 preferably has one end 72 looped for attachment about a post 74 on the cam 12. The harness string 66 is attached to the cam such that a portion of the harness string 66 is entrained about the cam 12 and lies generally in the same plane P2 as one portion of the draw string 14. The other end of the harness string 66 is preferably split or bifurcated having a pair of looped ends 76 for attachment about the axle 38 rotatably carrying the idler wheel 40. As the cam 12 rotates when the drawstring 14 is drawn, the harness string 66 is taken up in the track of the adjuster 16 lying in plane P2, effectively shortening the harness string 66 and flexing the bow limbs 28, 30 accordingly.

In the presently preferred embodiment shown and described herein, the first end 51 of the adjuster 16 is attached to the cam 12 by the fastener 56 which is received in one of the holes 52(*a*–*f*) of the attachment array 52. The second end 53 of the adjuster 16 may be positioned in one of the holes 46(*a*–*f*), 48(*a*–*f*), or 50(*a*–*f*) to vary the draw weight of the bow. More specifically, when the second end 53 of the adjuster 16 is connected to the cam 12 via any one of the holes 46(*a*–*f*) of the adjustment array 46 (generally designated position A shown in phantom lines in FIG. 2), the bow will have a first draw weight. This draw weight may be, for example without limitation, 45 pounds, and may be substantially the same in any hole 46(*a*–*f*) of array 46 in which the adjuster 16 is connected to the cam 12. To change the draw weight of the bow, the second end 53 of the adjuster 16 can be moved so that it is connected to the cam 12 via one of the holes 48(*a–f*) of another adjustment array 48 (position B in FIG. 2) providing a second draw weight which may be, for example without limitation, 55 pounds. A still different draw weight of the bow 10 can be obtained by moving the second end 53 of the adjuster 16 on the cam 12 so that it is connected in one of the holes 50(*a–f*) of the array 50 (Position C in FIG. 2). This provides a third draw weight that may be, for example without limitation, 65 pounds. Accordingly, a wide range of draw weights can be obtained by moving the second end 53 of the adjuster 16 among the arrays 46, 48, 50.

Like the array 46, the holes 48(*a–f*), in the adjustment array 48 can be located so that regardless of the position of the adjuster within the array 48 the bow 10 will have substantially the same draw weight. The same may be true of the holes 50(*a–f*) and array 50, so that when the second end 53 of the adjuster is in any position in array 50, the bow 10 may have the same draw weight.

The draw weight of the bow 10 varies as the adjuster 16 is moved between the different arrays 46, 48 and 50, because the amount of the harness string 66 that is taken up when the bow 10 is drawn varies as the adjuster 16 is moved between the arrays 46, 48, 50. The array 50 is positioned generally furthest away from the axle 38 and hence, a greater amount of harness string 66 is taken up as the cam 12 is rotated when the bow 10 is drawn. Conversely, the array 46 is positioned generally closest to the axle 38 and therefore a lesser amount of harness string 66 is taken up as the cam 12 is drawn.

The amount of harness string 66 taken up is related to the flexing and loading of the bow limbs 28, 30, the energy stored in the bow 10, and the draw weight or force required to draw the draw string 14. The harness string 66 is substantially inextensible and is connected at one end to the cam 12 adjacent the free end 36 of one limb 30 and to the axle 38 adjacent the free end 34 of the other limb 28. Rotation of the cam 12 during a draw of the bowstring 14 rotates the post 74 and adjuster 16 relative to the axle 38 on limb 30. During at least a portion of the rotation of the cam during a full draw of the bow, the adjuster 16 engages the harness string 66, and a portion of the harness string 66 is wrapped on at least a portion of the adjuster 16. "Taking-up" the harness string 66 in this manner can be thought of as reducing the effective length of the harness string 66, and to accommodate and permit this, the bow limbs are increasingly flexed, shortening the distance between the ends 34, 36 of the limbs 28, 30. Hence, the more harness string 66 that is taken up during the draw, the more the limbs are flexed, and typically, the greater the draw weight of the bow.

Of course, additional adjustment of the draw weights can be obtained by adjustment of the bolts 32 securing the limbs 28, 30 to the riser 20. This provides a range of possible draw weights associated with each array 46, 48, 50. For example, without limitation, when the second end 53 of the adjuster 16 is in array 46, draw weights between about 45–60 pounds can be obtained, in array 48 draw weights between 55 to 70 pounds can be obtained, and in array 50 draw weights between 65 and 80 pounds can be obtained. These draw weights are representative of only one embodiment cam 12 and other draw weights can be obtained by providing different positions of the adjuster 16, or an adjuster of a different form.

In addition to permitting adjustment of the draw weight by moving the adjuster 16 amongst the different arrays 46, 48, 50, the second end 53 of the adjuster 16 may also be moved within a particular array to vary the draw length of the bow 10. Since in the embodiment shown, the adjuster 16 is a single piece of the material having a fixed length, when the second end 53 of the adjuster 16 is moved within a particular array, the first end 51 must likewise be moved within the attachment array 52. In this manner, each hole 52(*a–f*) of the attachment array 52 has a corresponding hole 46(*a–f*) in the adjustment array 46, and likewise for holes 48(*a–f*) and 50(*a–f*) in the adjustment arrays 48 and 50, respectively.

Figure 4:
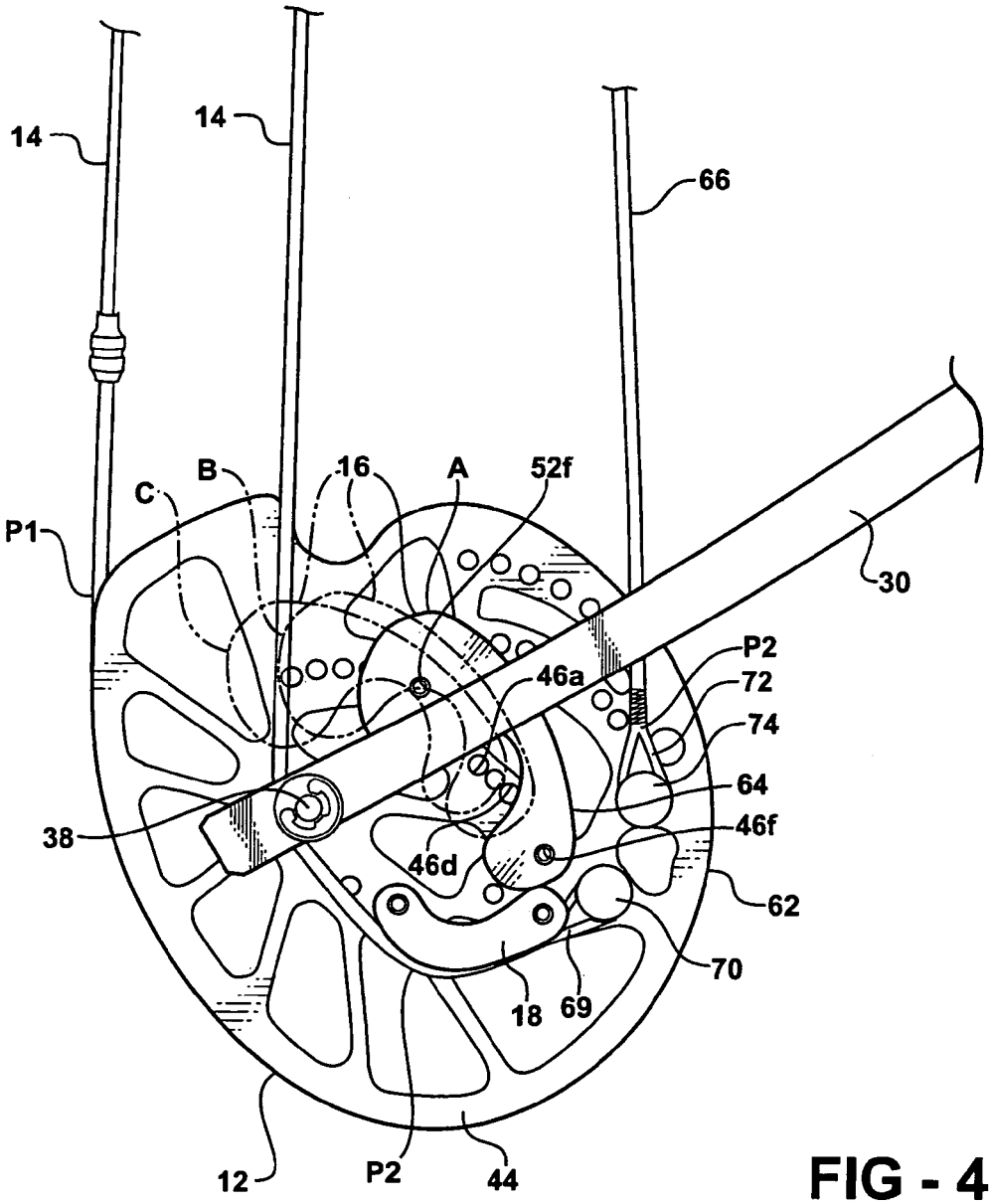
FIG. 4 is a side view of the cam of FIG. 1 in an undrawn position with the adjuster shown in another position.
Figure 5:
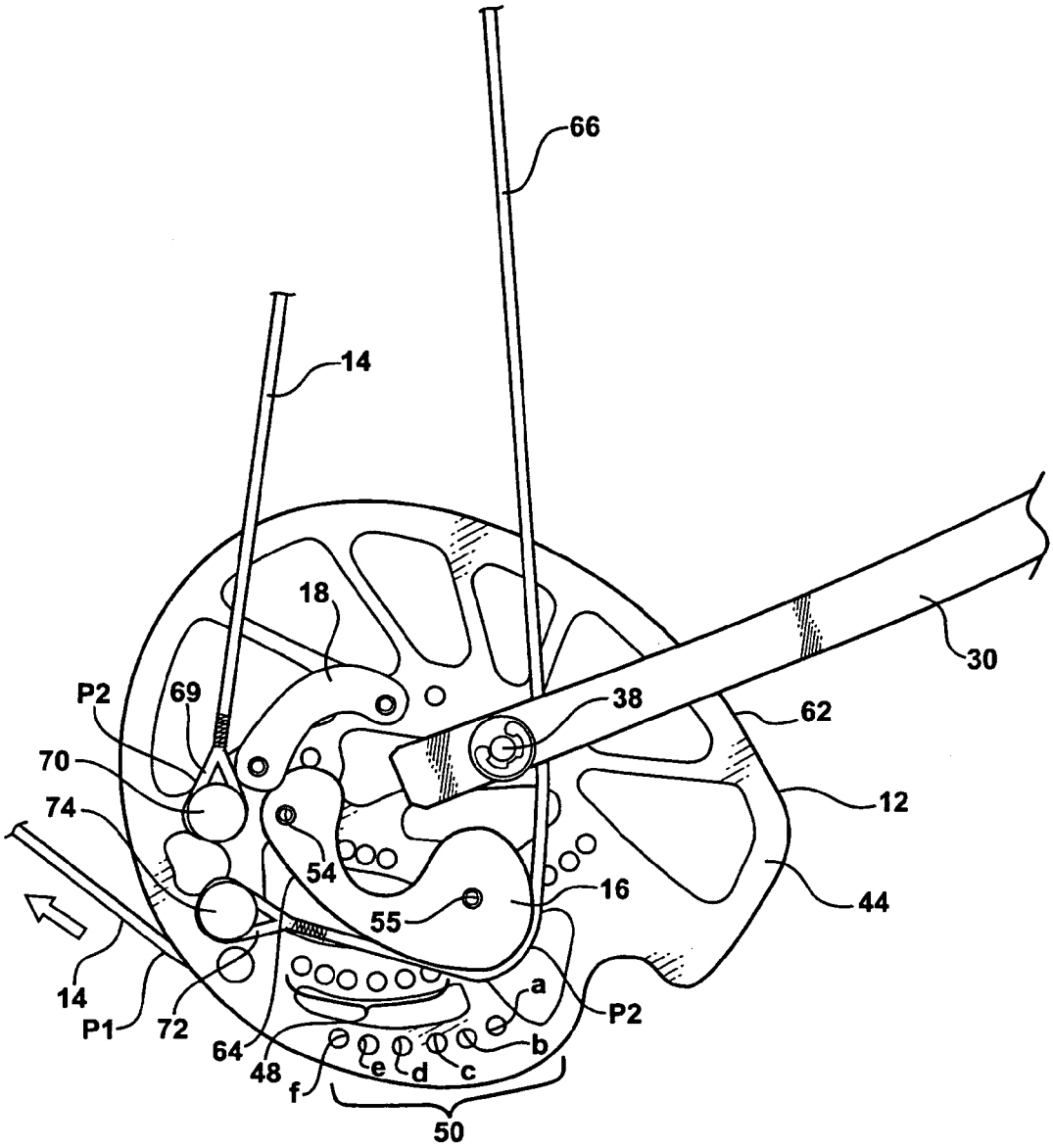
FIG. 5 is a view similar to FIG. 4 with the cam shown in a drawn position.

For example, as shown in FIG. 4, when the adjuster 16 is shown in position A illustrated in solid lines, the first end 51 of the adjuster 16 is attached to the cam 12 via attachment array hole 52*f* and the second end 53 of the adjuster 16 is attached to the cam via hole 46*f* in adjustment array 46. In position A, the bow has its minimum draw length, for example 25 inches. In this position, the adjuster is generally closer to the harness string 66, engages the harness string 66 sooner during the rotation of the cam 12 than it would in position C (shown in phantom), and thereby requires less rotation of the cam 12 to reach the let-off point and maximum draw point providing a shorter draw length for a full draw than when the adjuster 16 is in position C. As is understood in the art, the let-off point during the draw is achieved when the first end 51 engages with the harness string and passes "over center" or past the axle 38 as the cam 12 is rotated, and the maximum draw point occurs after the let-off point when the harness string 66 engages either the axle 38 or the stop 18, in the embodiment shown.

When the adjuster is in position C, shown in FIG. 4, the adjuster 16 interacts with the harness string 66 later in the rotation of the cam 12 and hence, more rotation of the cam 12 is required to reach the let-off and maximum draw point, providing a longer draw length to the fully drawn position of the bow. As shown, in position C the first end 51 of the adjuster 16 may be connected to the cam via hole 52*a* and the second end of the adjuster is connected to the cam via hole 46*a*. In this position, the bow has its maximum draw length, for example 31 inches. When the adjuster 16 is in positions intermediate of position A and position C, for example, position B shown in FIG. 4, a draw length between the minimum draw length (realized when the adjuster is in position A) and the maximum draw length (realized when the adjuster is in position C) is obtained. The draw length may be changed in a desired increment, as shown, the cam 12 and adjuster 16 provide six different draw lengths at one inch increments.

In the embodiment shown, the holes 46(*a–f*) of the adjustment array 46 are located and arranged so that in whatever position of the adjuster 16 within the array 46 a substantially similar amount of the harness string 66 is taken up during rotation of the cam 12 to provide a substantially constant draw weight of the bow 10, regardless of the draw length chosen. With respect to the adjustment arrays 48 and 50, the draw length of the bow 10 may be altered in the same manner as discussed with reference to the adjustment array 46. In other words, the second end of the adjuster 16 can be positioned in the various holes 48(*a–f*), 50(*a–f*) of the adjustment arrays 48, 50 to vary the position of the adjuster 16 and correspondingly, the draw length of the bow 10. As also discussed with reference to the adjustment array 46, the draw weight of the bow 10 can be made substantially constant regardless of the position of the adjuster 16 within a particular array 48, 50.

Accordingly, to change the draw weight of the bow 10, the second end 53 of the adjuster 16 is moved to a different array 46, 48 or 50. To change the draw length of the bow 10, the second end 53 of the adjuster 16 is moved within a particular array 46, 48, 50 to one of a plurality of positions defined by the various holes 46(*a–f*), 48(*a–f*) and 50(*a–f*) in the arrays. Of course, the various holes in the cam 12 can be arranged in substantially any manner to provide a wide range of draw length and draw weight settings for the bow 10 that can be easily achieved, in most cases even without a bow press.

Figure 2:
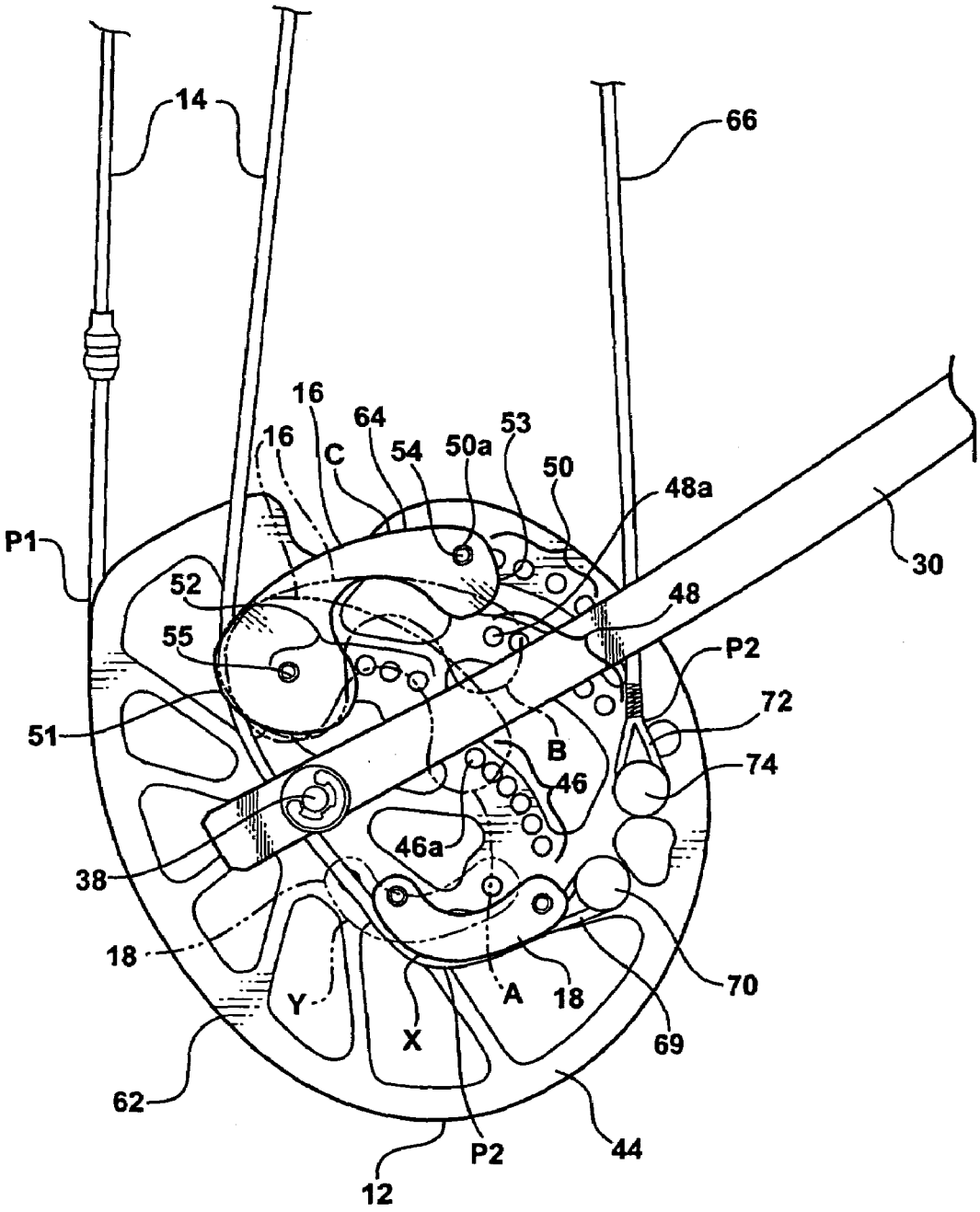
FIG. 2 is a side view of the cam of FIG. 1 in an undrawn position with an adjuster shown in one position.
Figure 3:
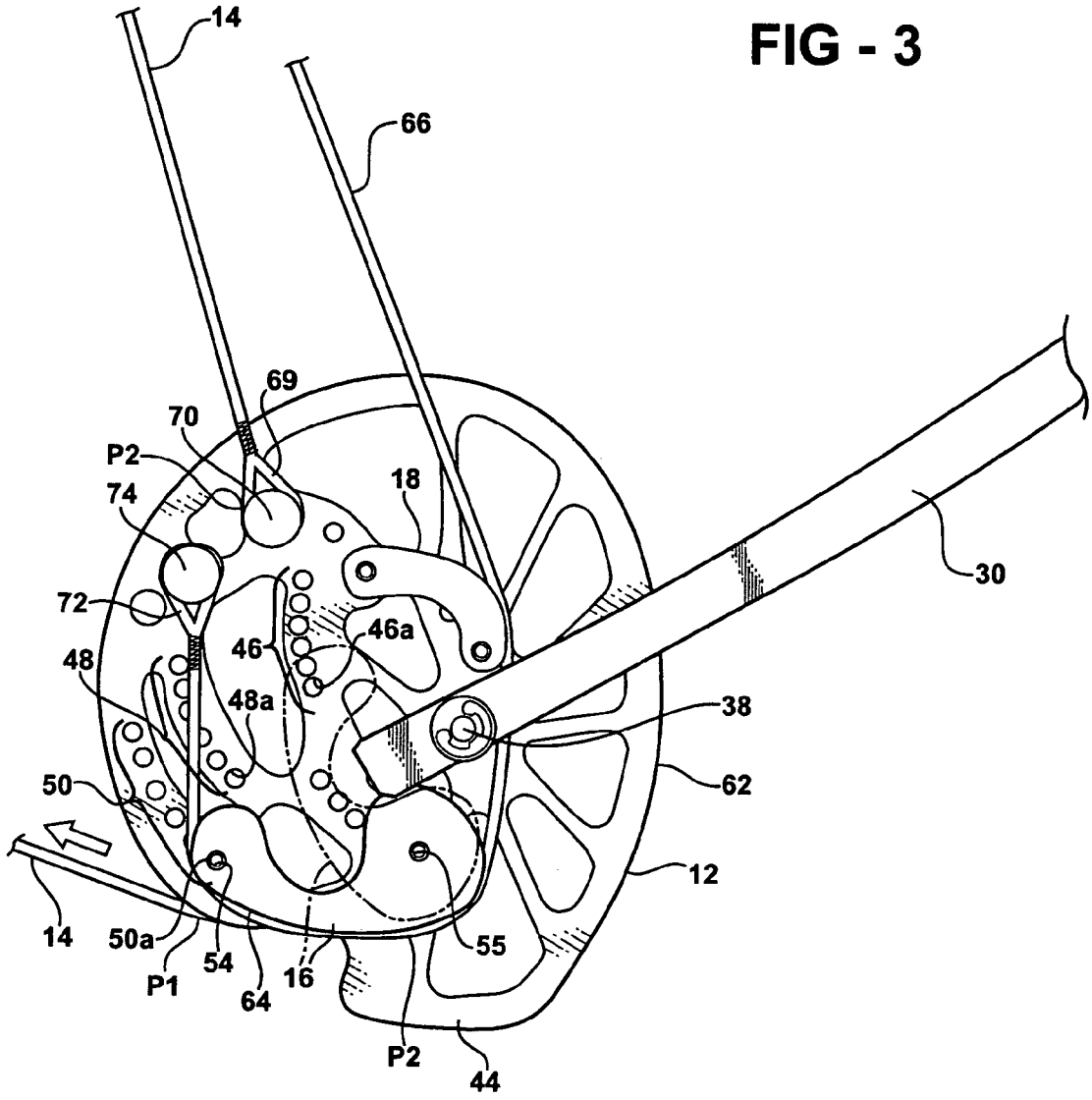
FIG. 3 is a view similar to FIG. 2 with the cam shown in a drawn position.

Aside from being able to adjust the draw weight and draw length of the draw string 14, the amount or magnitude of let-off or reduction in draw weight from the maximum draw weight may be adjusted. As shown in FIG. 2, the stop 18 is shown having two positions for adjustment on the body of the cam. In one position (X) the stop 18 provides for approximately a 50% to 65% reduction from the maximum draw weight, and in another position (Y) provides approximately for an 80% reduction from the maximum draw weight. The magnitude of let-off increases the further the drawstring 14 is drawn beyond the let-off point due to an increased mechanical advantage in the cam 12. So, moving the stop 18 changes the engagement of the harness string 66 with the stop to alter the magnitude of the let-off. In addition to adjusting the amount of reduction from the maximum draw weight, the stop 18 can also permit adjustment of the amount of travel of the knock point 71 laterally from an imaginary straight line 78 (FIG. 1). Generally, when the stop 18 is in the 65% reduction position (X), the amount of lateral travel of the knock point 71 from the imaginary straight line 78 is reduced from that of the lateral travel while the stop 18 is in the 80% reduction position (Y). An improved arrow flight may be obtained when the lateral travel of the knock point 71 from the imaginary straight line 78 is reduced. In some positions of the adjuster 16, the harness string 66 may contact the axle 38 to stop the draw, and may not contact the stop 18. In this situation, the axle 38 would limit the draw weight reduction, or let-off.

It should be recognized that though the adjuster 16 is shown to be generally kidney bean shaped, the adjuster 16 may take on any suitable geometry to achieve the desired effects while it engages the harness string 66. For instance, the perimeter of the adjuster 16 may take on a non-uniform and non-symmetrical geometry to provide for an increase or decrease in the amount of harness string 66 take-up while drawing the draw string 14, as desired. Additionally, though the adjuster 16 is shown as a single piece, it should be recognized that the adjuster may be constructed from any number of pieces, such as pins or the like to achieve the desired take-up of the harness string 66 while drawing the draw string 14. It should also be recognized that the adjuster 16 need not be completely releasable from the body 44 of the cam 12 to provide for the adjustment of the draw length and/or maximum draw weight, and that the adjuster 16 may simply pivot or slide relative to the body 44. While each array 46, 48, 50 has been shown as providing a plurality of draw lengths at a substantially constant draw length (for a given array), the draw weight may vary as desired among the different positions within a single array. The various draw weights and draw lengths within a particular array on among various arrays may be altered by changing the location of the holes as desired.

In use, while the bow 10 is at rest, the harness string 66 is attached at one end 72 to the post 74 on the cam 12 and lies in the plane P2. In addition, the draw string 14 is attached at one end 69 to the post 70, and is trained about a portion of the adjuster 16 and the stop 18, and lies in the plane P2. The draw string extends away from the cam 12, is entrained at least in part about the idler wheel 40, and is connected at its other end 67 to the post 68 on the cam 12, with the other end 67 lying in the plane P1. As the draw string 14 is drawn by a user, one end 69 of the draw string 14 uncoils from the cam 12 and one end 72 of the harness string 66 is entrained about the adjuster 16 on the cam 12, such that the end 72 of the harness string 66 and the end 69 of the draw string 14 remain generally in the same plane P2. In addition, while the draw string 14 is being drawn, the other end 67 of the draw string 14 remains in the plane P1 adjacent and parallel to the plane P2.

With the draw string 14 and the harness string 66 coiling and uncoiling in the two closely adjacent planes P1, P2 about the cam 12. The amount of side load imparted on the draw string 14, the harness string 66 and the cam 12 is reduced compared to conventional bows which have three separate planes or tracks for the harness string, a front or lead potion of the drawstring and the back or second portion of the drawstring. As a result of the closeness in lateral offset of the two planes P1, P2, the moment force applied to the strings 14, 66 is reduced from the moment experienced in bows having three separate tracks or planes. This increases the accuracy of the bow and reduces friction on the strings due at least in part to the reduced lateral force on the strings, and the draw string 14 and the harness string 66 are better able to track within their respective tracks in the cam 12. This results in reduced wear to the draw string 14 and harness string 66, in use, thereby extending the useful life of the bow 10 without need for service or repair.

The disclosed embodiment is representative of a presently preferred form of the invention, but is intended to be illustrative rather than definitive thereof. The invention is defined in the claims.

What is claimed is:

1. A cam for an archery bow, comprising:

a cam body providing guided entrainment of a bow string at least partially about the cam body;

at least one adjuster carried by the cam body for adjustment between at least two positions, and when the adjuster is arranged in a first position the adjuster engages a harness string of said bow string during at least a portion of the rotation of the cam body for a full draw of the archery bow to define at least in part a first draw weight and a first draw length of the bow, and when the adjuster is arranged in a second position the adjuster engages the harness string during at least a portion of the rotation of the cam body for a full draw of the archery bow to define at least in part a second draw weight and a second draw length of the bow, wherein the first draw weight is different from the second draw weight.

2. The cam of claim 1 wherein the first draw length is different from the second draw length.

3. The cam of claim 1 wherein when the adjuster is in the first position it engages the harness string during at least a portion of the rotation of the cam body for a full draw of the bow and a first amount of harness string is taken up to define the first draw weight, and when the adjuster is in the second position it engages the harness string during at least a portion of the rotation of the cam body for a full draw of the bow and the first amount of harness string is taken up with less rotation of the cam body whereby the bow has the same draw weight and a shorter draw length when the adjuster is in the second position than when the adjuster is in the first position.

4. The cam of claim 1 wherein when the adjuster is in the first position it engages the harness string during at least a portion of the rotation of the cam body for a full draw of the bow and a first amount of harness string is taken up to define the first draw weight, and when the adjuster is in the second position it engages the harness string during at least a portion of the rotation of the cam body for a full draw of the bow and a second amount of harness string is taken up to define the second draw weight that is different from the first draw weight, and wherein the cam body rotates the same amount during a full draw of the bow when the adjuster is in either of the first and second positions so that the bow has the same draw length when the adjuster is in either of its first and second positions.

5. The cam of claim 1 further comprising a stop carried by the cam body to engage the harness string and prevent further drawing of the bow string, thereby providing a limit to the draw length.

6. The cam of claim 5 wherein the stop can be moved between at least two positions and in at least one position the stop engages the harness string after the cam body has rotated past a let-offpoint to provide a limit to the magnitude of the let-off from the draw weight by between about 50 percent to 80 percent at a full draw of the bow.

7. The cam of claim 6 wherein the stop is separate from the adjuster and the stop can be moved independently of the adjuster.

8. The cam of claim 1 wherein the cam body has a pair of tracks with a first track lying in a first plane and a second track lying in a second plane laterally spaced from the first plane, and wherein during at least a portion of a draw of the bow the first track receives at least a portion of a draw string of the bow string and the second track receives at least a portion of the draw string and at least a portion of the harness string.

9. The cam of claim 8 wherein the cam body has a periphery defining at least in part the first track and the second track is defined at least in part by the adjuster.

10. A cam for an archery bow, comprising:

a cam body suitable for guided entrainment of a bow string at least partially about the cam body; and at least one adjuster carried by the cam body for adjustment between at least two positions and when arranged in a first of said at least two positions, the adjuster engages a harness string of said bow string during at least a portion of the rotation of the cam body for a full draw of the archery bow and a first amount of the harness string is taken up to define a first draw weight of the bow, and when arranged in a second of said at least two positions, the adjuster engages the harness string during at least a portion of the rotation of the cam body for a full draw of the archery bow and a second amount of the harness string different from the first amount is taken up to define a second draw weight of the bow that is different from said first draw weight.

11. The cam of claim 10 wherein the adjuster can be moved to a third position and when the adjuster is in said third position, the first amount of harness string is taken up with less rotation of the cam body for a full draw of the archery bow than when the adjuster is in said first position providing a shorter draw length for a full draw of the bow in said third position than in said first position.

12. The cam of claim 10 wherein the cam body rotates a similar amount for a full draw of the bow when the adjuster is in either said first position or said second position so that the draw length remains substantially constant when the adjuster is moved between the first and second positions.

13. The cam of claim 10 wherein in each of the first and second positions of the adjuster the cam body rotates a different amount so that the draw length for a full draw of the bow is different when the adjuster is in said first position than when the adjuster is in its second position.

14. The cam of claim 10 wherein the adjuster is adjustable between at least three different positions on the cam body to take up at least three different amounts of the harness string during a full draw of the archery bow to define at least three different draw weights of the bow.

15. The cam of claim 14 wherein the at least three different draw weights span a range of approximately 35 pounds.

16. The cam of claim 10 further comprising a stop carried by the cam body to engage the harness string and prevent further drawing of the bow string, thereby providing a limit to the draw length.

17. The cam of claim 16 wherein the stop can be moved between at least two positions and in at least one position the stop engages the harness string after the cam body has rotated past a let-offpoint to provide a limit to the magnitude of the let-off from the draw weight by between about 50 percent to 80 percent at a full draw of the bow.

18. The cam of claim 17 wherein the stop is separate from the adjuster and the stop can be moved independently of the adjuster.

19. The cam of claim 10 wherein the cam body has a first adjustment array providing for a plurality of positions in which the adjuster can be mounted on the body with each position providing a different draw length of the archery bow, and when the adjuster is in any of the positions associated with said first adjustment array the bow has substantially the same draw weight.

20. The cam of claim 19 which also comprises a second adjustment array providing for a plurality of positions in which the adjuster can be mounted on the cam body that are different from said plurality of positions associated with said first adjustment array, with each position of the adjuster in the second adjustment array providing a different draw length of the bow, and when the adjuster is in any of the positions of the second adjustment array the bow has substantially the same draw weight.

21. The cam of claim 20 wherein the draw weight achieved when the adjuster is in one of the positions of the first adjustment array is different than the draw weight achieved by when the adjuster is in one of the positions of the second adjustment array.

22. The cam of claim 10 wherein the cam body has a pair of tracks with a first track lying in a first plane and a second track lying in a second plane laterally spaced from the first plane, and wherein during at least a portion of a draw of the bow the first track receives at least a portion of a draw string of the bow string and the second track receives at least a portion of the draw string and at least a portion of the harness string.

23. The cam of claim 22 wherein the cam body has a periphery defining at least in part the first track and the second track is defined at least in part by the adjuster.

24. A cam for an archery bow, comprising:

a body providing for guided entrainment of a bow string at least partially about the body;

at least one adjuster carried by the body for adjustment between at least two positions and when arranged in a first position the adjuster engages the harness string during at least a portion of the rotation of the body for a full draw of the bow, and takes up a first amount of the harness string to define at least in part a first draw length of the bow, and when arranged in a second position, the adjuster engages the harness string during at least a portion of the rotation of the body for a full draw of the bow and takes up said first amount of the harness string with less rotation of the cam than is required when the adjuster is in the first position to define at least in part a second draw length of the bow that is less than the first draw length; and wherein the adjuster may be carried by the body in a third position and when the adjuster is arranged in the third position, the adjuster engages the harness string during at least a portion of the rotation of the body and takes up a second amount of the harness string different from said first amount to define a draw weight of the bow that is different than when the adjuster is in the first or second positions.

25. The cam of claim 24 which also comprises an axle passage in the cam body having an axis about which the cam body rotates when the bow is drawn, and a post carried by the cam body spaced from the axle passage and constructed for attachment of one end of the harness string thereto, the adjuster being positioned closer to the post when the adjuster is in the first position than when the adjuster is in the second position.

26. The cam of claim 24 further comprising a stop carried by the body for adjustment between at least two positions and arranged in one of said at least two positions so that, during at least a portion of the rotation of the body, the stop engages the harness string providing a positive stop to at least one of the first and second draw lengths.

27. The cam of claim 24 wherein the cam body has a pair of tracks with a first track lying in a first plane and a second track lying in a second plane laterally spaced from the first plane, and wherein during at least a portion of a draw of the bow the first track receives at least a portion of a draw string of the bow string and the second track receives at least a portion of the draw string and at least a portion of the harness string.

28. The cam of claim 27 wherein the cam body has a periphery defining at least in part the first track and the second track is defined at least in part by the adjuster.

29. An archery bow, comprising:

a riser;

a pair of limbs carried by the riser with each limb having a free end spaced from the riser;

at least one cam having a body rotatably carried adjacent a free end of a limb;

a bow string having a draw string entrained at least partially about the body, and a harness string;

at least one adjuster carried by the body for adjustment between at least two positions, and when the adjuster is arranged in a first position the adjuster engages a harness string of said bow string during at least a portion of the rotation of the body for a full draw of the archery bow to define at least in part a first draw weight and a first draw length of the bow, and when the adjuster is arranged in a second position the adjuster engages the harness string during at least a portion of the rotation of the body for a full draw of the archery bow to define at least in part a second draw weight and a second draw length of the bow, wherein the first draw weight is different from the second draw weight.

30. The archery bow of claim 29 wherein the first draw length is different from the second draw length.

31. The archery bow of claim 29 wherein when the adjuster is in the first position it engages the harness string during at least a portion of the rotation of the cam body for a full draw of the bow and a first amount of harness string is taken up to define the first draw weight, and when the adjuster is in the second position it engages the harness string during at least a portion of the rotation of the cam body for a full draw of the bow and a second amount of harness string is taken up to define the second draw weight that is different from the first draw weight, and wherein the cam body rotates the same amount during a full draw of the bow when the adjuster is in either of the first and second positions so that the bow has the same draw length when the adjuster is in either of its first and second positions.

32. The archery bow of claim 29 further comprising a stop carried by the body to engage the harness string and prevent further drawing of the bow string, thereby providing a limit to the draw length.

33. The archery bow of claim 32 wherein the stop can be moved between at least two positions and in at least one position the stop engages the harness string after the cam body has rotated past a let-off point to provide a limit to the magnitude of the let-off from the draw weight by between about 50 percent to 80 percent at a full draw of the bow.

34. The archery bow of claim 33 wherein the stop is separate from the adjuster and the stop can be moved independently of the adjuster.

35. A cam for an archery bow having a draw string and a harness string comprising:

a cam body having a pair of tracks with a first track lying in a first plane and a second track lying in a second plane laterally spaced from the first plane and defined at least in part by a member carried by the cam body, and wherein during at least a portion of a draw of the bow the first track receives at least a portion of a draw string and the second track receives at least a portion of the draw string and at least a portion of a harness string and said member is adjustable carried by the cam body permitting at least a portion of the second track to be moved relative to the cam body.

36. The cam of claim 35 wherein the first and second planes are substantially parallel and adjacent to one another.

37. The cam of claim 35 wherein the first track is defined at least in part by a groove formed in at least a portion of the periphery of the cam body and the second track is defined at least in part by a member carried by the cam body.

38. The cam of claim 35 wherein the second track remains substantially in the second plane as the member is adjusted from one position to another on the cam body.

39. The cam of claim 35 wherein the member can be mounted on the cam body in at least two positions to vary draw weight of the draw string.

40. The cam of claim 35 wherein the member can be mounted on the cam body in at least two positions to vary the draw length of the draw string.

41. The cam of claim 35 wherein the member can be mounted on the cam body in at least two positions to vary both the draw weight and draw length of the draw string.

* * * * *